US011350676B1

(12) United States Patent
Law

(10) Patent No.: US 11,350,676 B1
(45) Date of Patent: Jun. 7, 2022

(54) GARMENT SYSTEM

(71) Applicant: Katharine Sin Yee Law, Sayreville, NJ (US)

(72) Inventor: Katharine Sin Yee Law, Sayreville, NJ (US)

( * ) Notice: Subject to any disclaimer, the term of this patent is extended or adjusted under 35 U.S.C. 154(b) by 387 days.

(21) Appl. No.: 16/789,627

(22) Filed: Feb. 13, 2020

(51) Int. Cl.
*A41B 1/06* (2006.01)
*A41F 5/00* (2006.01)
*A41F 17/00* (2006.01)

(52) U.S. Cl.
CPC ..... *A41B 1/06* (2013.01); *A41F 5/00* (2013.01); *A41F 17/00* (2013.01)

(58) Field of Classification Search
CPC .... A41B 1/06; A41B 9/02; A41B 9/14; A41F 5/00; A41F 17/00; A41F 9/00; A41F 9/02; A41F 9/025
See application file for complete search history.

(56) References Cited

U.S. PATENT DOCUMENTS

| | | | |
|---|---|---|---|
| 756,567 | A | 4/1904 | Beerwald |
| 2,018,666 | A | 10/1935 | Flesh |
| 2,036,322 | A | 4/1936 | Ellinger |
| 5,214,806 | A | 6/1993 | Flores |
| 5,515,544 | A | 5/1996 | Hosking |
| 6,397,393 | B2 | 6/2002 | Alger |
| 7,398,558 | B1 | 7/2008 | Kattenhorn |
| 2015/0040285 | A1 | 2/2015 | Mobayyen |
| 2016/0324238 | A1 | 11/2016 | Tran |
| 2017/0202283 | A1 | 7/2017 | Chou |

*Primary Examiner* — Katherine M Moran
*Assistant Examiner* — Erick I Lopez
(74) *Attorney, Agent, or Firm* — Goldstein Law Offices, P.C.

(57) ABSTRACT

A garment system is disclosed. The garment system includes an upper garment, a lower garment, and a strap for attaching the upper garment to the lower garment. The upper garment includes a plurality of apertures disposed around a waist region. The lower garment includes a first fastener, a second fastener, and a third fastener. The strap includes a fourth fastener, a fifth fastener, a first aperture, and a second aperture. The strap attaches to the upper garment through the fifth fastener. The strap attaches to the lower garment through the second fastener, the third fastener, the fourth fastener, the fifth fastener, the first aperture, and the second aperture. Attachment of the strap to the upper garment and the lower garment interconnects the upper garment and the lower garment to each other, thereby forming a secure connection between the garments that maintains the upper garment in a tucked in position.

20 Claims, 11 Drawing Sheets

GARMENT SYSTEM

TECHNICAL FIELD

The present disclosure relates generally to a system for maintaining donned upper garments tucked in to preserve a neat appearance. More particularly, the present disclosure relates to a garment system including an upper garment, a lower garment, and a strap including an attachment means for interconnecting the upper garment and lower garment to each other.

BACKGROUND

Many upper garments such as shirts and blouses are designed to be worn tucked into lower garments, such as pants, shorts, and skirts. Additionally, many individuals like to tuck in their upper garments for the purpose of maintaining a professional or neat appearance. However, after a while, movement of the individual typically makes the upper garment become untucked either partially or completely.

Some devices attempt to solve this problem, but have disadvantages in that they are uncomfortable to wear because they are too stiff or bulky. Thus, the individual must choose whether to sacrifice comfort to keep their upper garment tucked in or sacrifice a neat appearance to be comfortable. Another disadvantage of these devices is that they are unappealing in that they can be seen from the exterior of the garment, thereby detracting from the desired look of the individual. Yet another disadvantage is that these devices are too rigid in that they do not provide much flexibility of the upper garment relative to the lower garment when attached. Therefore, a system is needed for maintaining an upper garment tucked into a lower garment that can overcome one or more disadvantages of the prior art.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a garment system including a means for attaching an upper garment to a lower garment in order to maintain the upper garment tucked in for extended periods of time. Accordingly, the present disclosure provides a garment system including an upper garment, a lower garment, and an attachment strap for attaching the upper garment to the lower garment.

Another aspect of an example embodiment in the present disclosure is to provide a garment system including a lower garment having a fastening means enabling the lower garment to be interchangeable. Accordingly, the present disclosure provides fasteners positioned on a waistband of the lower garment.

Yet another aspect of an example embodiment in the present disclosure is to provide a garment system including a lightweight, small, and flexible attachment means for interconnecting the upper garment and the lower garment in order to create a comfortable, flexible, and hidden connection between the upper garment and lower garment. Accordingly, the present disclosure provides a planar and flexible attachment strap having fasteners on a first side and second side that interconnect the upper garment and lower garment in a discrete manner.

Still another aspect of an example embodiment in the present disclosure is to provide an easy-to-use garment system which enables efficient attachment between the upper garment and the lower garment. Accordingly, the present disclosure provides an upper garment including apertures disposed around a waist region and a lower garment including fasteners disposed around a waistband, such when attaching the upper garment to the lower garment with the attachment strap, the apertures of the upper garment and the fasteners of the lower garment are adjacent to each other, thereby facilitating securement of the strap to the upper garment and lower garment.

A further aspect of an example embodiment in the present disclosure is to provide a means for facilitating attachment of a rear side of the upper garment to a rear side of the lower garment when the upper garment and the lower garment are donned. Accordingly, the present disclosure provides a hook and loop fastening means on the rear of the lower garment and a hook and loop fastener on a side of the attachment strap, as opposed to a button or alternative fastening means, such the attachment of the strap to the lower garment may be more easily manipulated.

Yet a further aspect of an example embodiment in the present disclosure is to provide a flexible connection between the upper garment and the lower garment when the upper garment is attached to the lower garment. Accordingly, the present disclosure provides buttons on the attachment strap that mate with the apertures of the upper garment, whereby the buttons are attached to the attachment strap using a flexible thread that enables more movement of the buttons and the upper garment relative to the strap when attached thereto.

Still a further aspect of an example embodiment in the present disclosure is to accommodate larger individuals with larger torsos. Accordingly, the present disclosure provides another set of apertures disposed around the waist region in a lower position relative to the other apertures disposed around the waist region such that the buttons of the attachment strap can attach at a lower point on the upper garment, thereby accommodating individuals with larger torsos.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

Figure 1A:
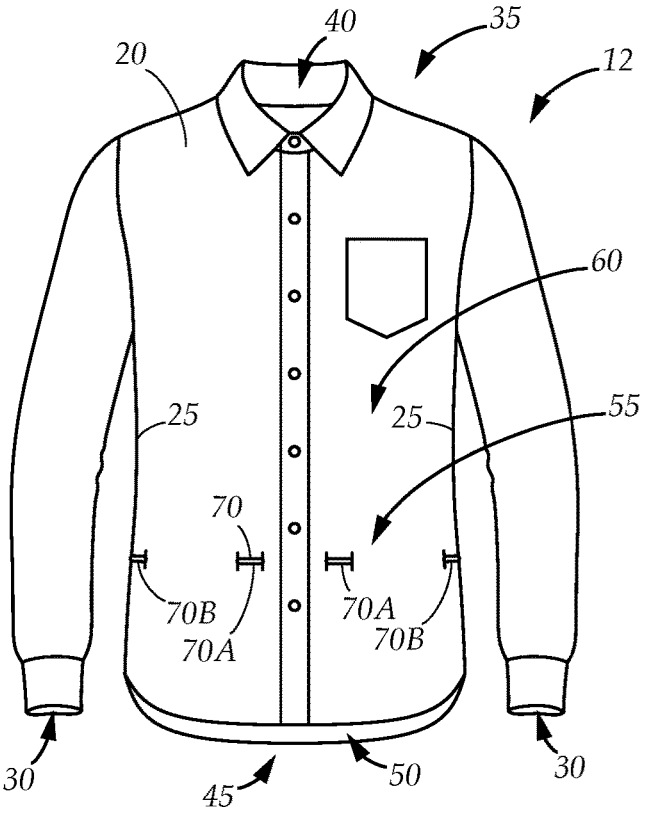
FIG. 1A shows a front view of the upper garment of the garment system according to one embodiment of the present disclosure.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION

FIGS. 6-10 show a garment system 10 comprising an upper garment 12, a lower garment 15, and a strap 20 configured to attach the upper garment 12 and to the lower garment 15 via several fasteners. FIGS. 1A-1D illustrate the upper garment 12 comprises a body 20 including opposing lateral sides 25 having arm openings 30, an upper end 35 including a neck opening 40, a bottom end 45 including a torso opening 50, a waist region 55 disposed between the upper end 35 and the bottom end 45, a front side 60, a rear side 65, and a plurality of apertures 70 disposed annularly around the waist region 55. FIGS. 1A-1D show the upper garment 12 comprising a shirt. In some embodiments, the upper garment 12 comprises a blouse.

Figure 1B:
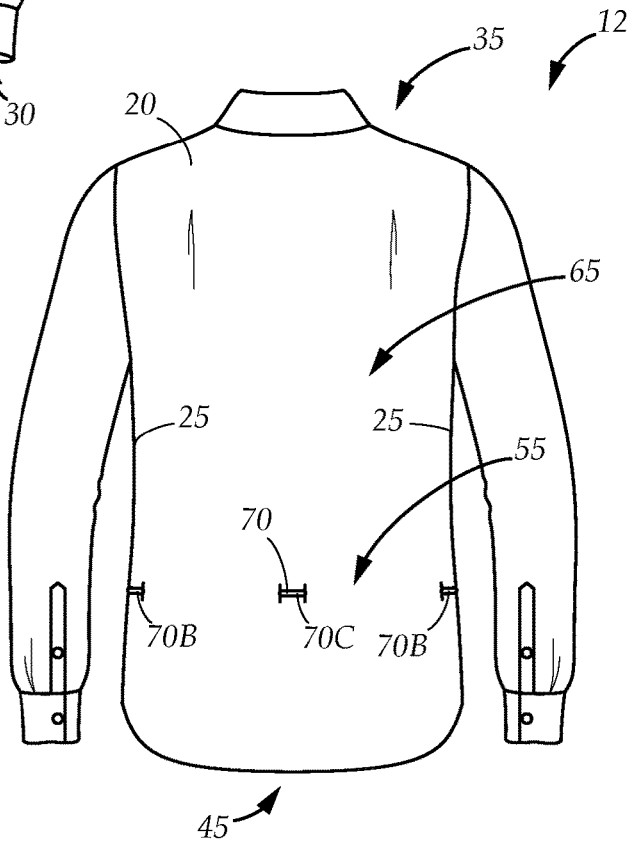
FIG. 1B shows a rear view of the upper garment of the garment system according to one embodiment of the present disclosure.

FIGS. 1A and 1B show the plurality of apertures 70 including a front set of apertures 70A, a lateral set of apertures 70B, and a rear aperture 70C that extend through the body 20. The front set of apertures 70A are disposed on the front side 60 of the body 20. The lateral set of apertures 70B are disposed on the opposing lateral sides 25 of the body 20. The rear aperture 70C is disposed on the rear side 65 of the body 20. The front set of apertures 70A are disposed symmetrically relative to each other about a central longitudinal axis of the front side 60 of the body 20. The lateral set of apertures 70B are disposed along a coronal plane, i.e., frontal plane, of the upper garment 12, such that the lateral set of apertures 70B are positioned on the lateral sides of a user when the upper garment 12 is donned. The rear aperture 70C is disposed along a central longitudinal axis of the rear side 65 of the body 20.

FIGS. 1A and 1B illustrate the plurality of apertures 70 spaced apart by equal intervals between one another, such that one or more of the apertures of the plurality of apertures 70 are evenly spaced around the waist region 55. In another embodiment, the plurality of apertures 70 are spaced by unequal intervals, such that one or more of the apertures of the plurality of apertures are unevenly spaced around the waist region 55.

Figure 1C:
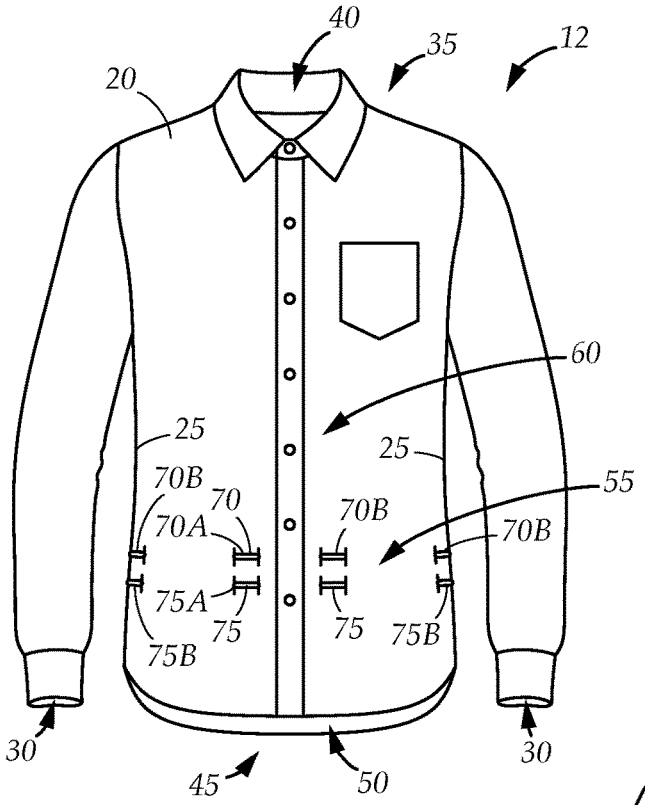
FIG. 1C shows a front view of the upper garment of the garment system according to another embodiment of the present disclosure.
Figure 1D:
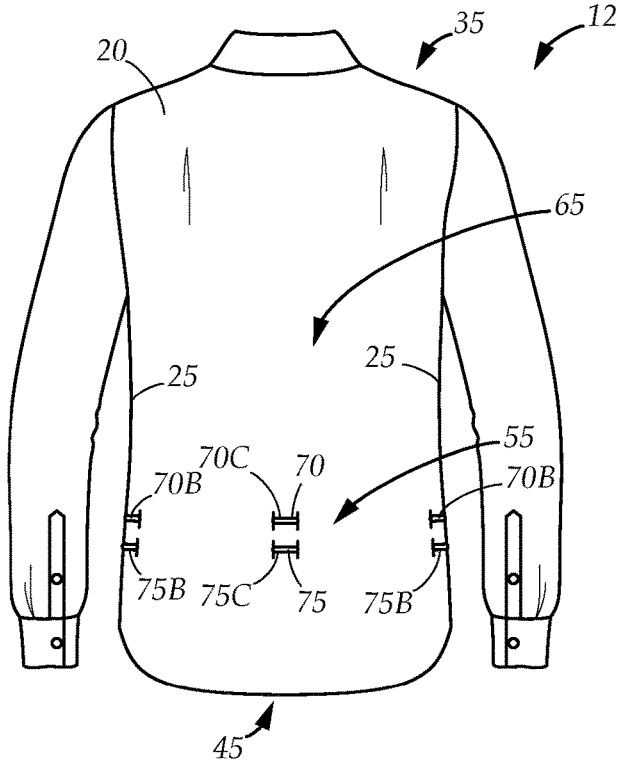
FIG. 1D shows a rear view of the upper garment of the garment system according to another embodiment of the present disclosure.

FIGS. 1C and 1D illustrate the body 20 which includes a second set of a plurality of apertures 75 disposed annularly around the waist region 55 of the body 20. The second set of plurality of apertures 75 include the same quantity of apertures as in the plurality of apertures 70. In one embodiment, the second set of plurality of apertures 75 are disposed adjacent to the plurality of apertures 70 between the plurality of apertures 70 and the bottom end 45. The second set of plurality of apertures 75 also include a front set of apertures 75A, a lateral set of apertures 75B, and a rear aperture 75C that extend through the body 20. The front set of apertures 75A are disposed on the front side 60 of the body 20. The lateral set of apertures 75B are disposed on the opposing lateral sides 25 of the body 20. The rear aperture 75C is disposed on the rear side 65 of the body 20. In one embodiment, the front set of apertures 75A, the lateral set of apertures 75B, and the rear apertures 75C are aligned with the front set of apertures 70A, the lateral set of apertures 70B, and the rear aperture 70C, respectively, such that the second set of apertures 75 and the plurality of apertures 70 are coaxial along a longitudinal axis of the body 20, and/or coplanar.

Figure 2A:
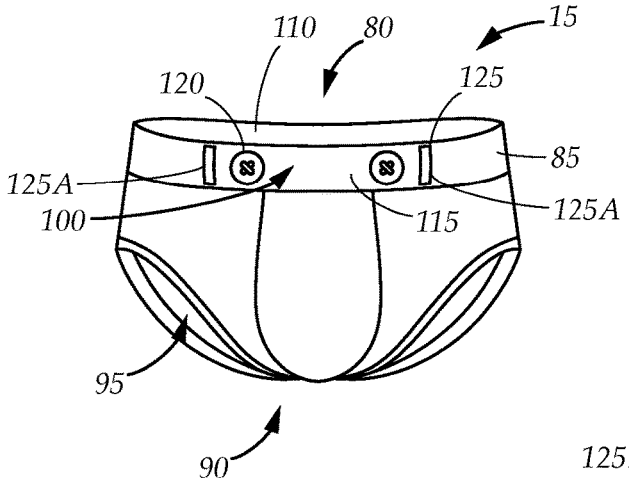
FIG. 2A shows a front view of the lower garment of the garment system according to one embodiment of the present disclosure.
Figure 2B:
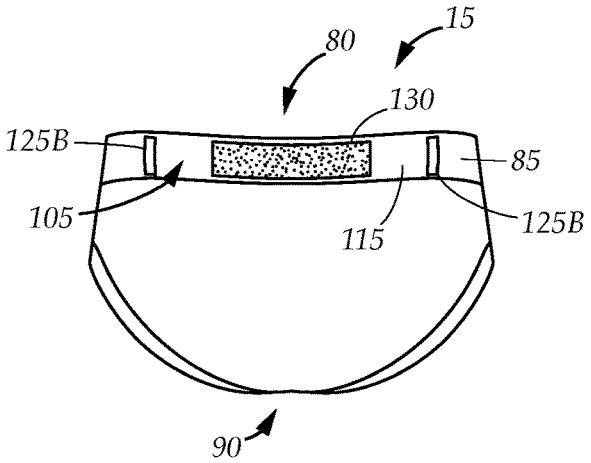
FIG. 2B shows a rear view of the lower garment of the garment system according to one embodiment of the present disclosure.
Figure 3A:
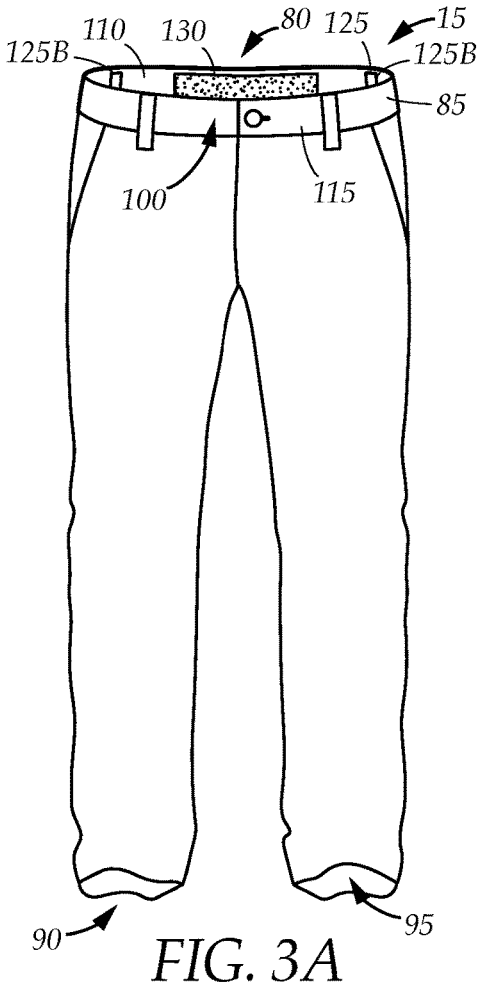
FIG. 3A shows a front view of the lower garment of the garment system according to another embodiment of the present disclosure.
Figure 3B:
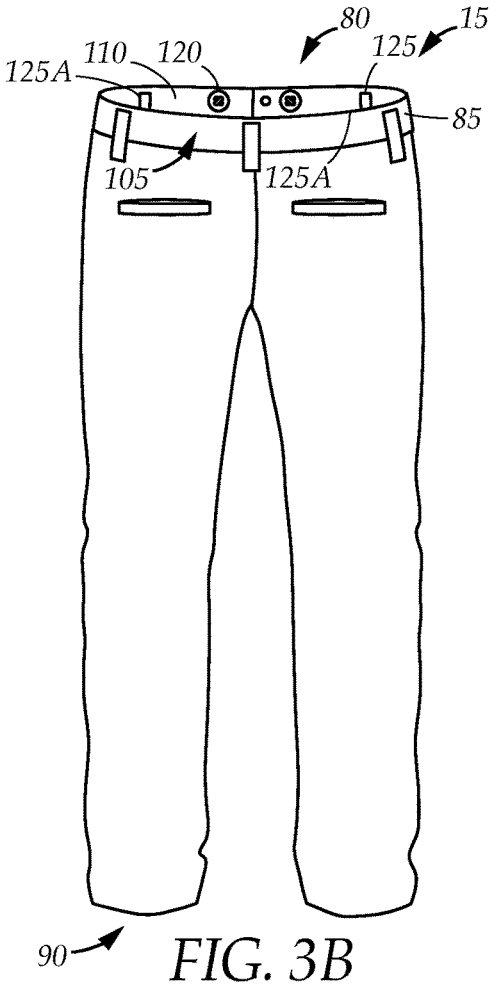
FIG. 3B shows a rear view of the lower garment of the garment system according to another embodiment of the present disclosure.

FIGS. 2A-2B and 3A-3B illustrate the lower garment 15 comprising an open upper end 80 including a waistband 85 and a lower end 90 including a leg opening 95. The waistband 85 comprises a front 100, a rear 105, an inner side 110, an outer side 115, a first fastener 120, a second fastener 125, and a third fastener 130. FIGS. 2A-2B show the lower garment 15 comprises an undergarment such as a brief. The undergarment includes the first fastener 120, the second fastener 125, and the third fastener 130 disposed on the outer side 115 of the waistband 85. FIGS. 3A-3B illustrate the lower garment 15 comprising a pair of pants. In this embodiment, the pants include the first fastener 120, the second fastener 125, and the third fastener 130 disposed on the inner side 110 of the waistband 85. In another embodiment, the lower garment 15 comprises a skirt or pair of shorts, in which the first fastener 120, the second fastener 125, and the third fastener 130 are disposed on the inner side 110 of the waistband 85.

FIGS. 2C-2D and 3C-3D illustrate the strap 20 comprising a first side 135, a second side 140, a first end 145, and a second end 150. The strap 20 comprises a fourth fastener 155 disposed on the first side 135, a fifth fastener 160 disposed on the second side 140, a first aperture 165 disposed near the first end 145, and a second aperture 170 disposed near the second end 150. The first and second apertures 165, 170 extend through the strap 20 and are configured to receive the first fastener 120 (see FIG. 2A) therethrough. The strap 20 comprises a flexible and/or bendable material that enables the strap to twist and bend in order to increase range of motion. In certain embodiments, the strap 20 comprises a planar member.

Figure 2C:
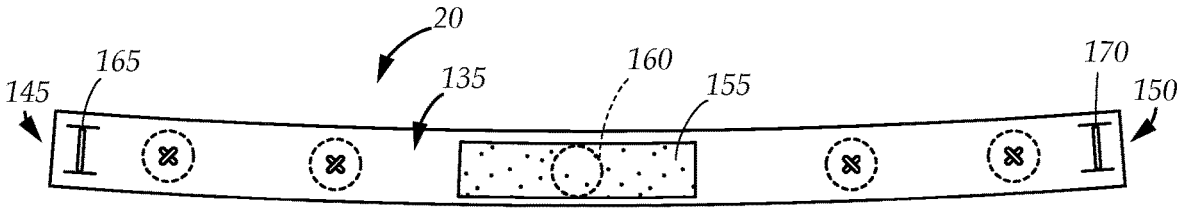
FIG. 2C shows a front view of the strap of the garment system according to one embodiment of the present disclosure.
Figure 2D:
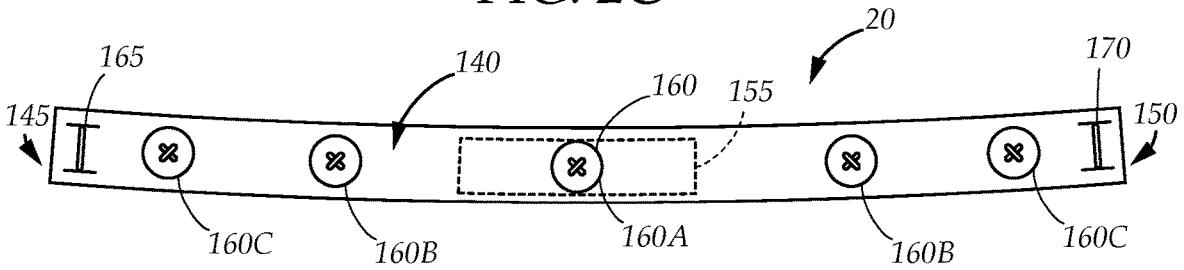
FIG. 2D shows a rear view of the strap of the garment system according to one embodiment of the present disclosure.

FIG. 2A illustrates the first fastener 120 comprises a pair of buttons, which mate with the first and second apertures 165, 170 (see FIGS. 2C-2D). FIGS. 2A-2B and 3A-3B illustrate the second fastener 125 comprising a front set of loops 125A disposed on the front 100 of the lower garment 15 and a rear set of loops 125B disposed on the rear 105 of the lower garment 15. The front set of loops 125A and the rear set of loops 125B receive the strap 20 (see FIGS. 2C-2D and 3C-3D) therethrough.

FIGS. 2B and 3A illustrate the third fastener 130 comprising a hook and loop fastener. FIGS. 2C and 3D illustrates the fourth fastener 155 comprising a hook and loop fastener. The hook and loop fasteners correspond to each other, such that the third and fourth fasteners 130, 155 mate with each other. For example, in one embodiment, the third fastener 130 comprises a male hook and loop fastener while the fourth fastener 155 comprises a female hook and loop fastener. In another embodiment, the third fastener 130 comprises a female hook and loop fastener while the fourth fastener 155 comprises a male hook and loop fastener. FIGS. 2A and 3B illustrates the first fastener 120 is disposed between the front set of loops 125A. FIGS. 2B and 3A illustrates the third fastener 130 is disposed between the rear set of loops 125B.

Figure 3C:
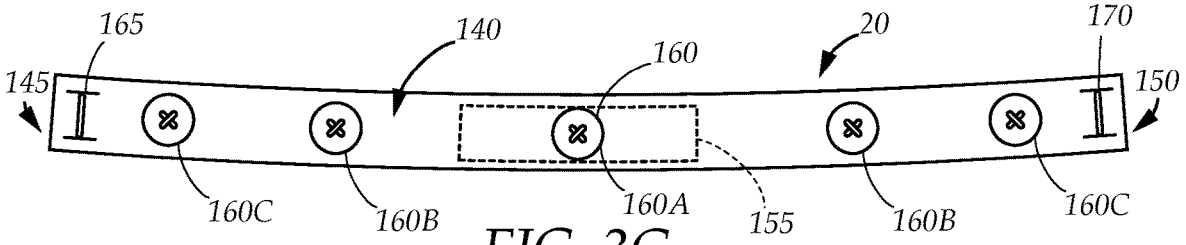
FIG. 3C shows a rear view of the strap of the garment system according to one embodiment of the present disclosure.
Figure 3D:
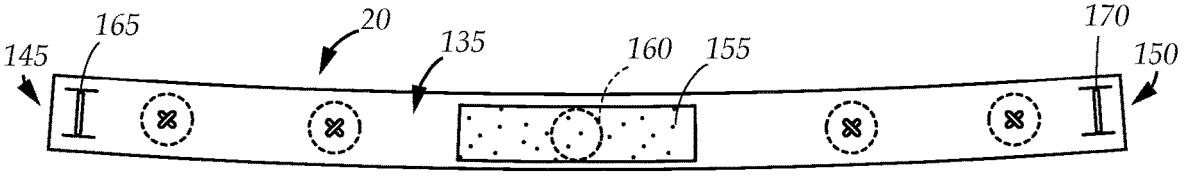
FIG. 3D shows a front view of the strap of the garment system according to one embodiment of the present disclosure.

FIGS. 2D and 3C illustrate the fifth fastener 160 comprises a plurality of buttons including spaced intervals. The spaced intervals of the plurality of buttons correspond to the spaced intervals of the plurality of apertures 70 (see FIGS. 1A-1D) and/or the second set of plurality of apertures 75 (see FIGS. 1C-1D). In this way, the plurality of apertures 70 and the second set of plurality of apertures 75 can receive the plurality of buttons therethrough. The plurality of buttons are linearly aligned along a longitudinal length of the second side 140 of the strap 20. The plurality of buttons comprise a central button 160A, a first set of inner buttons 160B, and a second set of outer buttons 160C. In operation, the central button 160A mates with the rear apertures 70C, 75C, the first set of inner buttons 160B mate with the lateral set of apertures 70B, 75B, and the second set of outer buttons 160C mate with the front set of apertures 70A, 75A. In one embodiment, the plurality of buttons are affixed to the strap 20 via flexible and/or stretchy material, such that each of the plurality of buttons may move with the upper garment 12 (see FIGS. 1A-1D) when mated with the plurality of apertures 70. In this way, the upper garment 12 is provided a larger range of motion relative to the lower garment 15 (see FIGS. 2A-2B and 3A-3B) and strap 20 when attached to the lower garment 15 via the strap 20.

Figure 4:
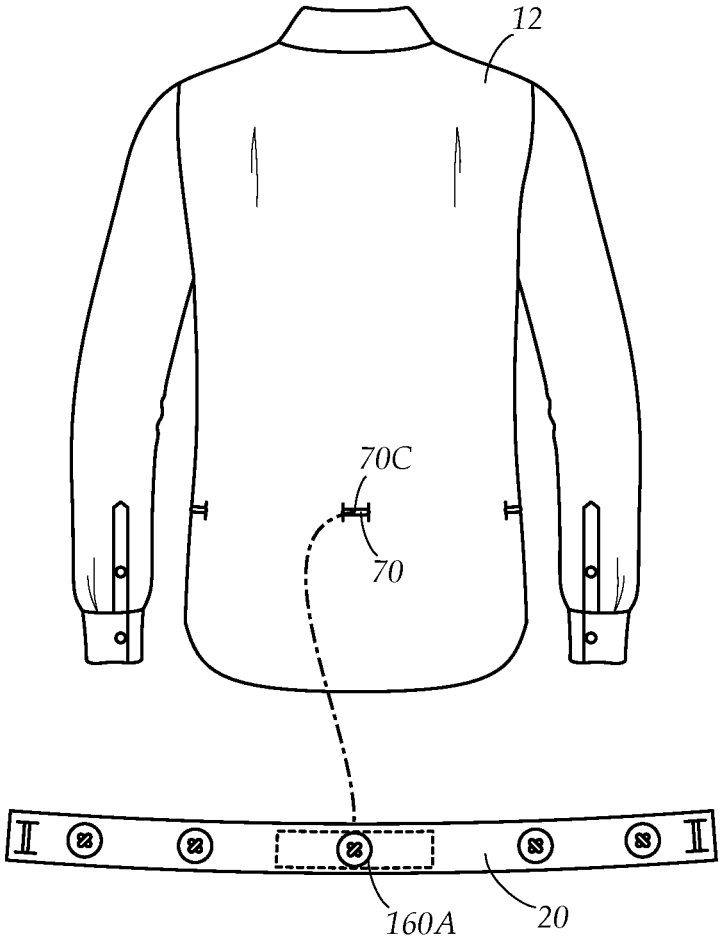
FIG. 4 shows an exploded rear view of the garment system with the strap attaching to the rear side of the upper garment according to one embodiment of the present disclosure.
Figure 5:
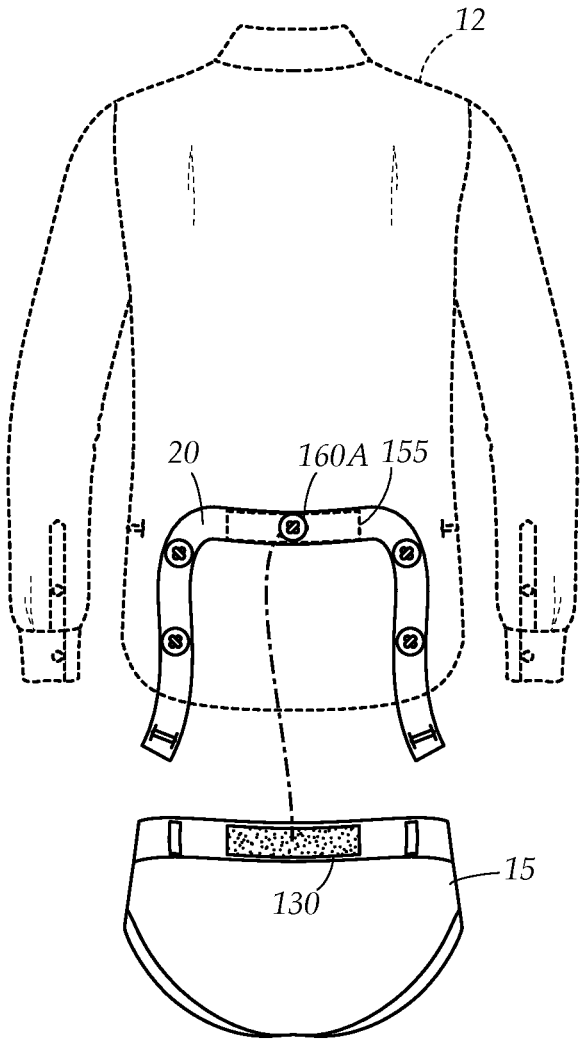
FIG. 5 shows an exploded rear view of the garment system, with the upper garment shown in phantom, and with the strap attached to the interior of the rear side of the upper garment and the lower garment fastening to the strap according to one embodiment of the present disclosure.
Figure 6:
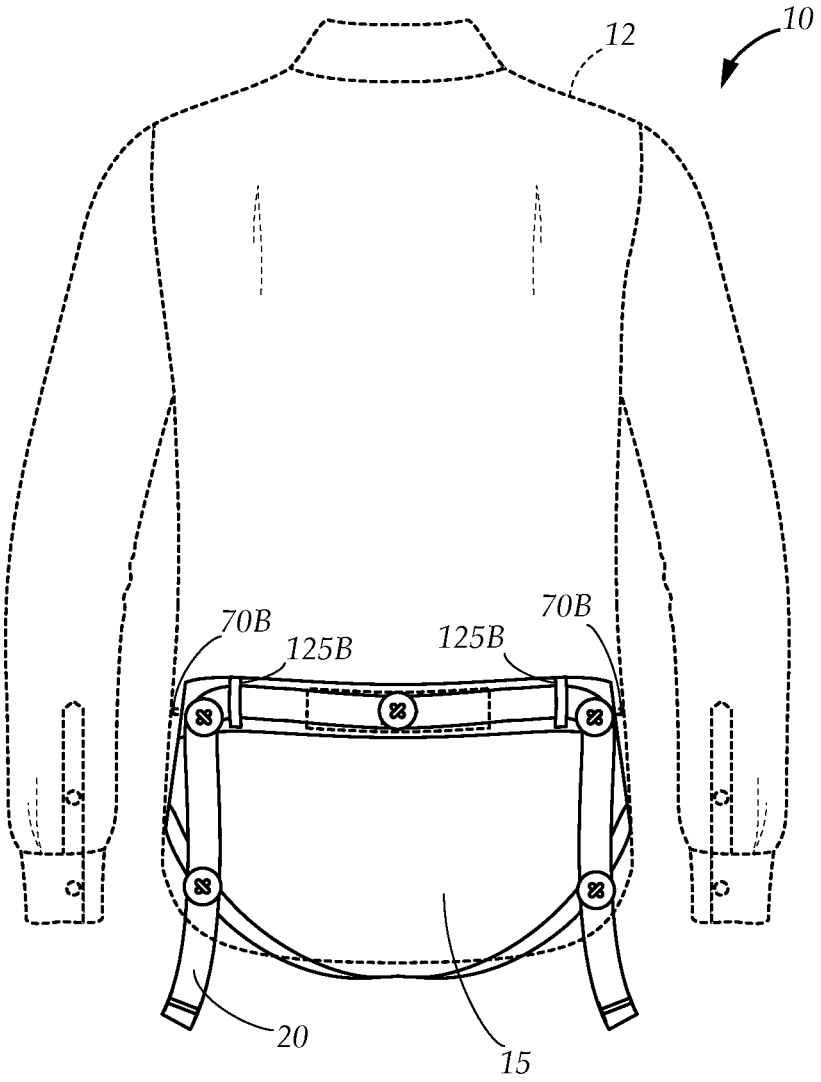
FIG. 6 shows a rear view of the garment system, with the upper garment shown in phantom, and with the first side of the strap partially fastened to the waistband of the lower garment and the second side of the strap attached to the interior of the rear side of the upper garment according to one embodiment of the present disclosure.
Figure 7:
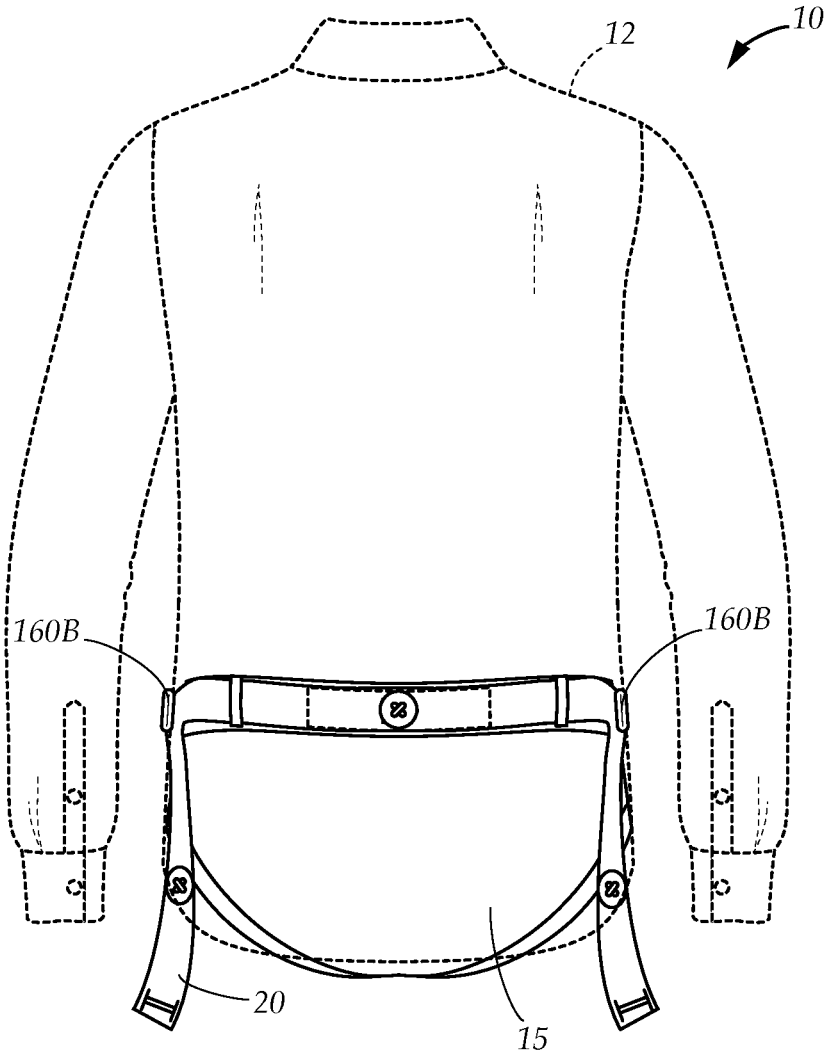
FIG. 7 shows a rear view of the garment system, with the upper garment shown in phantom, and with the first side of the strap partially fastened to the waistband of the lower garment and the second side of the strap attached to the interior of the rear side and opposing lateral sides of the upper garment according to one embodiment of the present disclosure.
Figure 8:
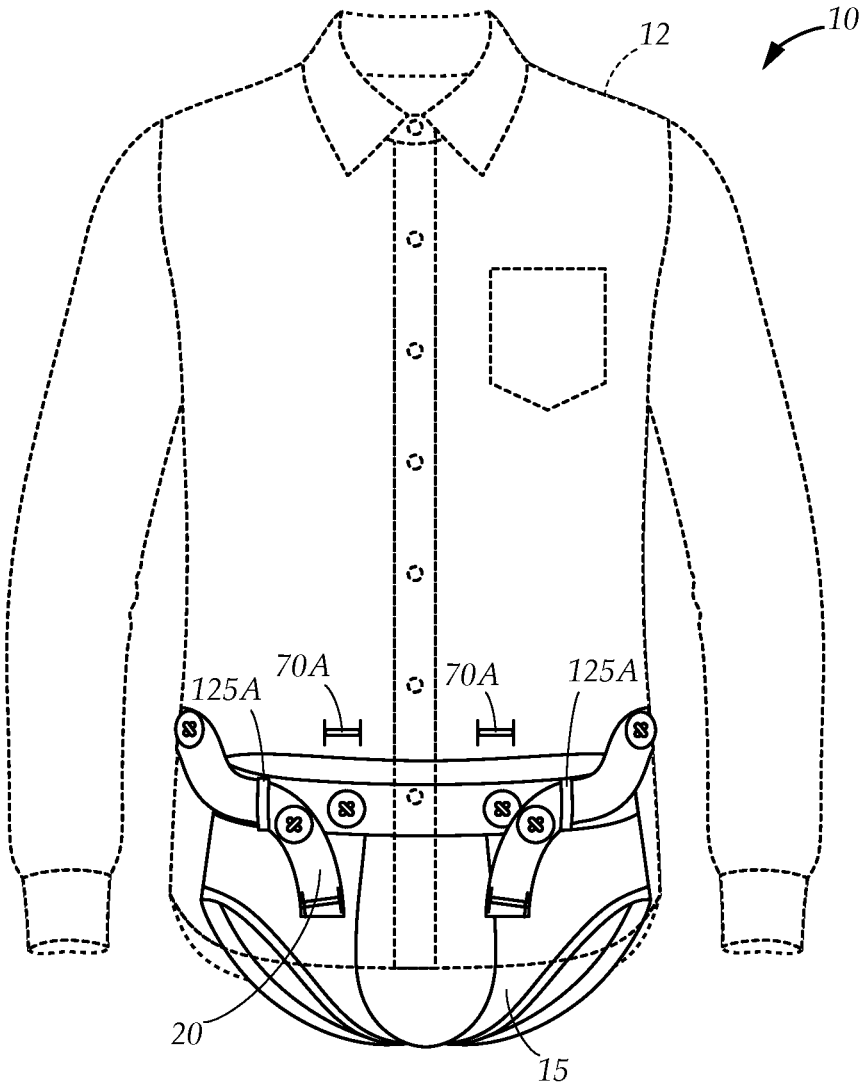
FIG. 8 shows a front view of the garment system, with the upper garment shown in phantom, and with the first side of the strap partially fastened to the waistband of the lower garment and the second side of the strap attached to the interior of the rear side and opposing lateral sides of the upper garment according to one embodiment of the present disclosure.
Figure 9:
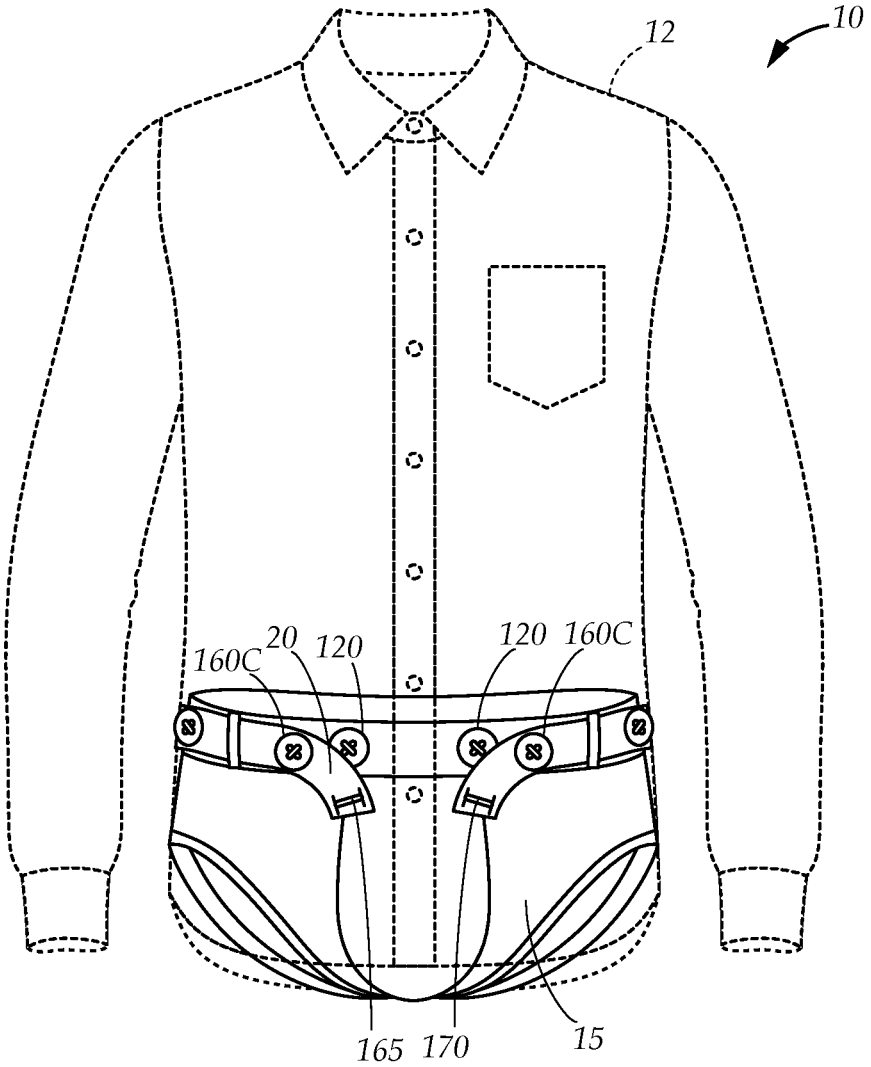
FIG. 9 shows a front view of the garment system, with the upper garment shown in phantom, and with the first side of the strap partially fastened to the waistband of the lower garment and the second side of the strap attached to the interior of the rear side, opposing lateral sides, and front side of the upper garment according to one embodiment of the present disclosure.
Figure 10:
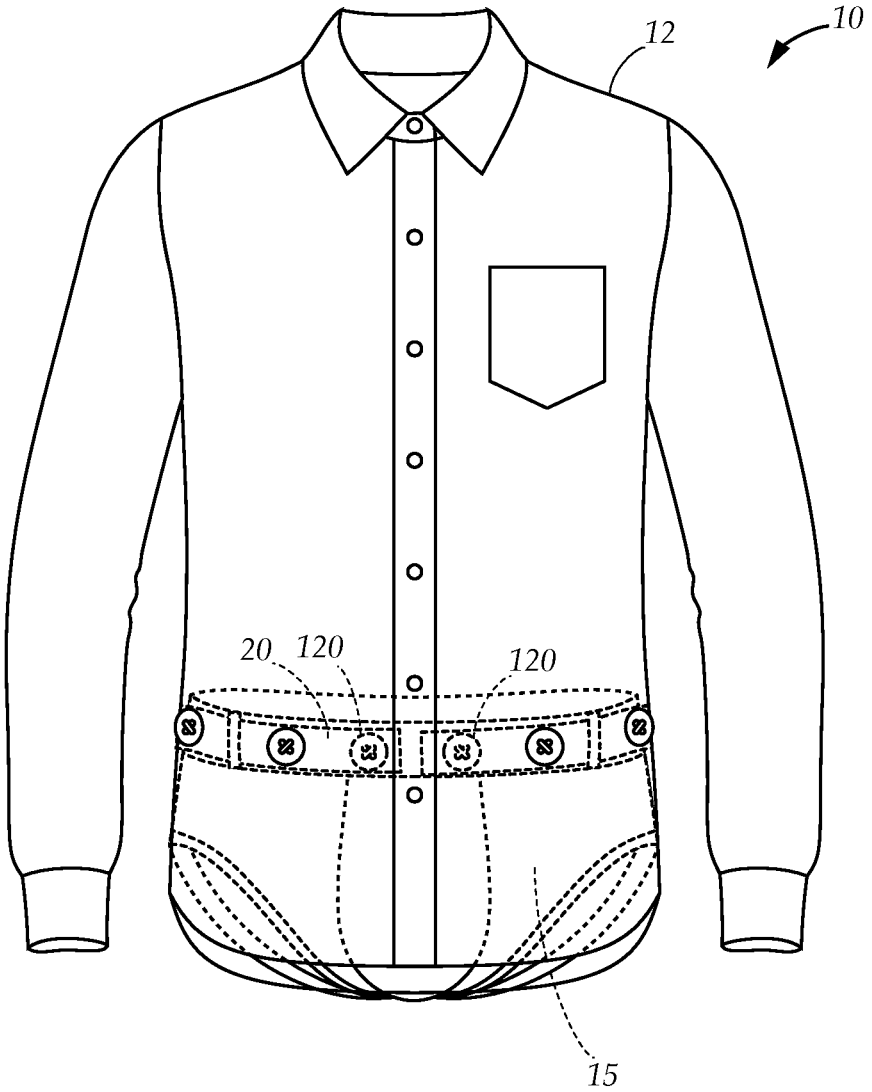
FIG. 10 shows a front view of the garment system, with the lower garment shown in phantom, and with the first side of the strap completely fastened to the waistband of the lower garment and the second side of the strap attached to the interior of the rear side, opposing lateral sides, and front side of the upper garment, illustrating the positioning of the lower garment, the upper garment, and the strap relative to one another when the lower garment and the upper garment are completely interconnected according to one embodiment of the present disclosure.

FIGS. 4-10 illustrate one operation of the garment system 10. FIGS. 4 and 5 illustrate to employ the garment system, a user mates the central button 160A of the strap 20 with the rear aperture 70C of the plurality of apertures 70 of the upper garment 12 to initially attach the strap 20 to an interior of the upper garment 12. FIGS. 5 and 6 illustrate that next the user dons the upper garment 12 and the lower garment 15 in no particular order in order to juxtapose the plurality of apertures 70 of the upper garment 12 with the first fastener (see FIGS. 2A and 3B), the second fastener 125, and third fastener 130 of the lower garment 15. FIGS. 5 and 6 illustrate that next the user mates the fourth fastener 155 of the strap 20 with the third fastener 130 of the lower garment 15 to partially interconnect the upper garment 12 and the lower garment 15. FIG. 6 illustrates that next the user threads the strap 20 through the rear set of loops 125B. FIGS. 6 and 7 illustrate that next the user mates the first set of inner buttons 160B of the strap with the lateral set of apertures 70B of the upper garment 12. FIG. 8 illustrates that next the user threads the strap 20 through the front set of loops 125A. FIGS. 8 and 9 illustrates that next the user mates the second set of outer buttons 160C of the strap 20 with the front set of apertures 70A. FIGS. 9 and 10 illustrates that lastly the user mates the first aperture 165 and the second aperture 170 of the strap 20 with the pair of buttons of the first fastener 120 to completely and securely interconnect the upper garment 12 with the lower garment 15.

FIG. 5 illustrates that in embodiments a user mates the central button 160A with the rear aperture 70C (see FIG. 4) before the upper garment 12 is donned. In certain embodiments, a user mates the fourth fastener 155 with the third fastener 130 after the upper garment 12 and the lower garment 15 are donned. FIG. 6 illustrates that in other embodiments, a user threads the strap 20 through the rear set of loops 125B after the central button 160A (see FIG. 5) is mated with the rear aperture 70C (see FIG. 4) and after the upper garment 12 and the lower garment 15 are donned. FIG. 7 illustrates that in some embodiments, a user mates the first set of inner buttons 160B with the lateral set of apertures 70B (see FIG. 6) after the strap 20 is threaded through the rear set of loops 125B (see FIG. 6). FIG. 8 illustrates that in certain embodiments, a user threads the strap 20 through the front set of loops 125A after the strap 20 is threaded through the rear set of loops 125B (see FIG. 6) and the first set of inner buttons 160B (see FIG. 7) are mated with the lateral set of apertures 70B (see FIG. 6). FIG. 9 illustrates that in some embodiments, a user mates the second set of outer buttons 160C with the front set of apertures 70A (see FIG. 8) after the strap 20 is threaded through the front set of loops 125B (see FIG. 6). FIG. 10 illustrates that in certain embodiments, a user mates the first aperture 165 (see FIG. 9) and the second aperture 170 (see FIG. 9) with the pair of buttons of the first fastener 120 after the strap 20 is threaded through the front set of loops 125A (see FIG. 8) and the second set of outer buttons 160C (see FIG. 9) are mated with the front set of apertures 70A (see FIG. 8).

In embodiments, the method of using the garment system includes donning the upper garment 12, donning the lower garment 15, attaching the upper garment 12 to the lower garment 15 with the strap 20 by threading the strap 20 through the second fastener 120 of the lower garment 15, mating the fourth fastener 155 (see FIG. 5) of the strap 20 with the third fastener 130 (see FIG. 5), mating the fifth fastener 160 (see FIG. 5) of the strap 20 with the plurality of apertures 70 (see FIG. 6) of the upper garment 12, and mating the first aperture 165 (see FIG. 9) and the second aperture 170 (see FIG. 9) with the first fastener 120.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a garment system for maintaining donned upper garments tucked within lower garments. The disclosure is illustrated by example in the drawing figures, and throughout the written description. It should be understood that numerous variations are possible, while adhering to the inventive concept. Such variations are contemplated as being a part of the present disclosure.

What is claimed is:

1. A garment system, comprising:

an upper garment including a body having opposing lateral sides including arm openings, an upper end including a neck opening, a bottom end including a torso opening, a waist region disposed between the upper end and the bottom end, a front side, a rear side, and a plurality of apertures disposed annularly around the waist region, the plurality of apertures including a front set of apertures, a lateral set of apertures, and a rear aperture, the plurality of apertures set at spaced intervals between one another and extending through the body;

a lower garment including an open upper end including a waistband and a lower end including a leg opening, the waistband including a front, a rear, an inner side, an outer side, a first fastener, a second fastener, and a third fastener; and a strap including a first side, a second side, a first end, and a second end, the strap including a fourth fastener disposed on the first side of the strap, a fifth fastener disposed on the second side of the strap, a first aperture disposed adjacent the first end, and a second aperture disposed adjacent the second end, the first and second aperture extending through the strap;

wherein the strap is configured to attach the upper garment to the lower garment via the fourth fastener, the fifth fastener, the first aperture, and the second aperture, wherein the strap is configured to interconnect the upper garment and the lower garment to each other.

2. The garment system of claim 1, wherein lower garment comprises an undergarment including the first fastener, the second fastener, and the third fastener disposed on the outer side of the waistband.

3. The garment system of claim 1, wherein the lower garment comprises a pair of pants including the first fastener, the second fastener, and the third fastener disposed on the inner side of the waistband.

4. The garment system of claim 1, wherein:

the fifth fastener comprises a plurality of buttons including spaced intervals therebetween and are configured to correspond to the spaced intervals of the plurality of apertures such that the plurality of apertures are configured to receive receive the plurality of buttons therethrough;

the plurality of buttons comprise a central button, a first set of inner buttons, and a second set of outer buttons;

the central button is configured to mate with the rear aperture;

the first set of inner buttons are configured to mate with the lateral set of apertures; and the second set of outer buttons are configured to mate with the front set of apertures.

5. The garment system of claim 4, wherein:

the second fastener comprises a front set of loops disposed on the front of the lower garment and a rear set of loops disposed on the rear of the lower garment; and the front set of loops and the rear set of loops are configured to receive the strap therethrough.

6. The garment system of claim 5, wherein:

the third fastener comprises a hook and loop fastener;

the fourth fastener comprises a hook and loop fastener; and the third fastener is configured to mate with the fourth fastener.

7. The garment system of claim 6, wherein:

the third fastener is disposed between the rear set of loops; and the first fastener is disposed between the front set of loops.

8. The garment system of claim 7, wherein:

the first fastener comprises a pair of buttons; and the first aperture and the second aperture are configured to receive the pair of buttons therethrough.

9. The garment system of claim 1, wherein:

the front set of apertures are disposed on the front side of the body; and the lateral set of apertures are disposed on the opposing lateral sides of the body; and the rear aperture is disposed on the rear side of the body.

10. The garment system of claim 9, wherein:

the front set of apertures are disposed symmetrically about a central longitudinal axis of the body; and the rear aperture is disposed along the central longitudinal axis of the body.

11. The garment system of claim 9, further comprising a second set of a plurality including the same quantity of apertures as plurality of apertures, wherein:

the second set of plurality of apertures are disposed annularly around the waist region of the body;

the second set of plurality of apertures are disposed adjacent to the plurality of apertures between the plurality of apertures and the bottom end of the body; and the second set of plurality of apertures are aligned with the plurality of apertures along a longitudinal length of the garment.

12. A method of using the garment system of claim 5, comprising:

mating the central button of the strap with the rear aperture of the upper garment;

mating the fourth fastener of the strap with the third fastener of the lower garment;

threading the strap through the rear set of loops;

mating the first set of inner buttons of the strap with the lateral set of apertures of the upper garment;

threading the strap through the front set of loops;

mating the second set of outer buttons of the strap with the front set of apertures;

mating the first aperture and the second aperture of the strap with the first fastener.

13. The method of claim 12, wherein the central button of the strap is mated with the rear aperture of the upper garment before the upper garment is donned.

14. The method of claim 13, wherein the fourth fastener is mated with the third fastener after the upper garment and the lower garment are donned.

15. The method of claim 14, wherein the strap is threaded through the rear set of loops after the central button is mated with the rear aperture and the upper garment and the lower garment are donned.

16. The method of claim 15, wherein the first set of inner buttons are mated with the lateral set of apertures after the strap is threaded through the rear set of loops.

17. The method of claim 16, wherein the strap is threaded through the front set of loops after the strap is threaded through the rear set of loops.

18. The method of claim 17, wherein the second set of outer buttons are mated with the front set of apertures after the strap is threaded through the front set of loops.

19. The method of claim 18, wherein the first aperture and the second aperture are mated with the first fastener after the strap is threaded through the front set of loops.

20. A method of using a garment system, comprising:

donning an upper garment comprising a body having opposing lateral sides including arm openings, an upper end including a neck opening, a bottom end including a torso opening, a waist region between the upper end and the bottom end, a front side, and a rear side, the upper garment including a plurality of apertures disposed annularly around the waist region, the plurality of apertures extending through the body;

donning a lower garment comprising an open upper end including a waistband and a lower end including a leg opening, the waistband including an inner side, an outer side, a first fastener, a second fastener, and a third fastener; and attaching the upper garment to the lower garment with a strap, the strap including a fourth fastener disposed on a first side of the strap, a fifth fastener disposed on a second side, a first aperture disposed adjacent to a first end of the strap, and a second aperture disposed adjacent to a second end of the strap, the first and second aperture extending through the strap, by:

threading the strap through the second fastener, mating the fourth fastener with the third fastener, mating the fifth fastener with the plurality of apertures, and mating the first aperture and the second aperture with the first fastener.

* * * * *